US006808371B2

(12) United States Patent
Niwatsukino et al.

(10) Patent No.: US 6,808,371 B2
(45) Date of Patent: Oct. 26, 2004

(54) ULTRA-THIN PUMP AND COOLING SYSTEM INCLUDING THE PUMP

(75) Inventors: Kyo Niwatsukino, Fukuoka (JP); Yoichi Shukuri, Fukuoka (JP); Yoshimitsu Aizono, Fukuoka (JP); Shigeru Narakino, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 94 days.

(21) Appl. No.: 10/251,779

(22) Filed: Sep. 23, 2002

(65) Prior Publication Data

US 2003/0072656 A1 Apr. 17, 2003

(30) Foreign Application Priority Data

Sep. 25, 2001 (JP) ..... 2001-291616
Oct. 29, 2001 (JP) ..... 2001-330463
Dec. 28, 2001 (JP) ..... 2001-400154

(51) Int. Cl.[7] ..... F04B 35/04; H05K 7/20

(52) U.S. Cl. ..... 417/353; 417/423.1; 417/423.12; 361/699

(58) Field of Search ..... 417/420.1, 352, 417/353, 354, 365, 423.1, 423.12, 423.15; 415/55.1, 55.2, 55.3, 55.4, 176, 177, 178; 361/139, 600, 627, 633, 638, 679, 687, 688, 689, 699, 697; 384/112, 121, 123; 310/69 B, 68 R, 40 MU; 165/80.2, 80.4; 220/79.6

(56) References Cited

U.S. PATENT DOCUMENTS 3,376,083 A * 4/1968 Albertus ..... 384/123
3,951,573 A * 4/1976 Dunning et al. ..... 417/423.13
6,100,618 A 8/2000 Schoeb et al.
6,220,826 B1 4/2001 Dobler et al.
2002/0075645 A1 * 6/2002 Kitano et al. ..... 361/687
2002/0196604 A1 * 12/2002 Lehman et al. ..... 361/688
2003/0002254 A1 * 1/2003 Faneuf et al. ..... 361/687
2003/0011983 A1 * 1/2003 Chu et al. ..... 361/687

FOREIGN PATENT DOCUMENTS

EP 1 091 472 4/2001
GB 2 313 158 11/1997
JP 53068406 A * 6/1978 ..... F04D/29/60
JP 58-91393 5/1983
JP 5-321872 12/1993
JP 2001-132699 5/2001

OTHER PUBLICATIONS

Patent Abstracts of Japan, vol. 2000, No. 22, Mar. 9, 2001 & JP 2001 132699 A (Matsushita Electric Ind. Co., Ltd.), May 18, 2001, Abstract.

* cited by examiner

*Primary Examiner*—Charles G. Freay
(74) *Attorney, Agent, or Firm*—Wenderoth, Lind & Ponack, L.L.P.

(57) ABSTRACT

An ultra-thin pump of the present invention includes a ring-shaped impeller including many vanes arranged along its outer region and a rotor magnet at its inner region, a motor stator provided in a space encircled by an inner peripheral surface of the rotor magnet of the impeller, and a pump casing that includes a suction port, a discharge port and a cylinder disposed between the motor stator and the rotor magnet and houses the impeller. The impeller is rotatably supported by the cylinder. A cooling system of the present invention includes a cooling device for cooling a heat-producing device by heat exchange using coolant, a radiator for removing heat from the coolant, and the ultra-thin pump for circulating the coolant. The ultra-thin pump is simple in structure, operates efficiently and can be manufactured at low cost, and the cooling system is thin in structure and performs efficient cooling.

23 Claims, 13 Drawing Sheets

ULTRA-THIN PUMP AND COOLING SYSTEM INCLUDING THE PUMP

TECHNICAL FIELD

The present invention relates to an ultra-thin pump and a cooling system including the pump.

BACKGROUND ART

To meet a recent demand for a cooling system for cooling an electronic device, such as a CPU, efficiently, a cooling system using circulation of coolant has received attention. The miniaturization of the electronic device entails many limitations of space for a coolant circulation pump used in such a cooling system. Accordingly, miniaturization and reduction of thickness are strongly demanded of the pump.

Conventional small-size pumps include a small-size centrifugal pump such as disclosed in Japanese Unexamined Patent Publication No. 2001-132699. This conventional small-size centrifugal pump is described hereinafter with reference to FIG. 15. Impeller 101 is rotatably supported by stationary shaft 102. Pump casing 103 secures ends of shaft 102, houses impeller 101 and defines a pump chamber for recovering pressure from kinetic energy imparted to fluid by impeller 101 and directing the fluid to discharge port 110. Impeller 101 is constructed of back shroud 104 and front shroud 105 having a suction opening in the center of impeller 101. Rotor magnet 106 is fixed to back shroud 104, and motor stator 107 is provided in a space enclosed by an inner surface of rotor magnet 106. Bulkhead 108 is provided between rotor magnet 106 and motor stator 107 for sealing the pump chamber. Pump casing 103 also includes suction port 109 and discharge port 110.

An operation of this conventional centrifugal pump is described as follows. When electric power is supplied from an external power source, current controlled by an electric circuit provided at the pump flows through coils of motor stator 107, which in turn generates a rotating magnetic field. This rotating magnetic field acts on rotor magnet 106 to impart physical force (rotational torque) to magnet 106. Since impeller 101 secures this rotor magnet 106 and is rotatably supported by stationary shaft 102, the rotational torque acts on impeller 101, whereby impeller 101 starts to rotate. Vanes provided between front and back shrouds 105, 104 change momentum of the fluid during the rotation of impeller 101. The fluid flowing in from suction port 109 receives the kinetic energy from impeller 101 and is directed to discharge port 110. The conventional centrifugal pump is small in size and low-profile because the outer rotor is used to drive the low-profile impeller, as described above. However, there is a limit to further reduction of the thickness of the centrifugal pump due to the structure of the impeller or the like.

On the other hand, a regenerative pump can be easily reduced in thickness. However, the conventional regenerative pump has various problems.

One of the particular problems is that the life of the regenerative pump is hard to extend due to the pump's durability to withstand radial load-induced friction at a rotating part and thrust load-induced friction between the impeller and the pump casing during the rotation of the impeller. The other problems include problems of higher efficiency and further reduction in thickness that are attributable to the structure of the regenerative pump.

SUMMARY OF THE INVENTION

An ultra-thin pump of the present invention includes:

a ring-shaped impeller including a plurality of vanes arranged along its outer region, and a rotor magnet at its inner region;

a motor stator provided in a space encircled by an inner peripheral surface of the rotor magnet of the impeller; and a pump casing for housing the impeller, the pump casing including a suction port, a discharge port and a cylinder disposed between the motor stator and the rotor magnet, wherein the impeller is rotatably supported by the cylinder.

A cooling system of the present invention includes:

a cooling device for cooling a heat-producing device by heat exchange using a coolant;

a radiator for removing heat from the coolant; and an ultra-thin pump for circulating the coolant.

DESCRIPTION OF THE PREFERRED EMBODIMENTS (Exemplary Embodiment 1)

Figure 1:
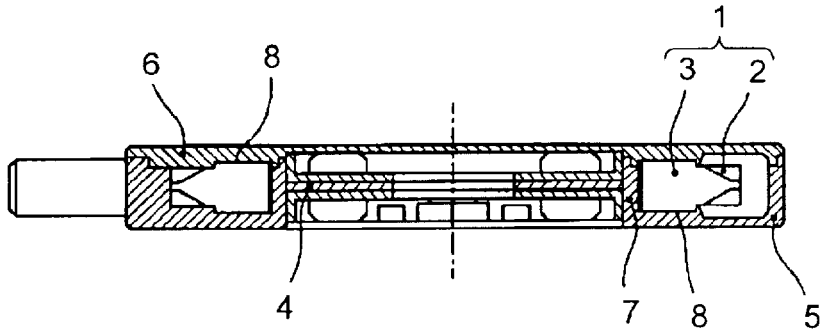
FIG. 1 is a sectional side elevation of an ultra-thin pump in accordance with a first exemplary embodiment of the present invention.
Figure 2:
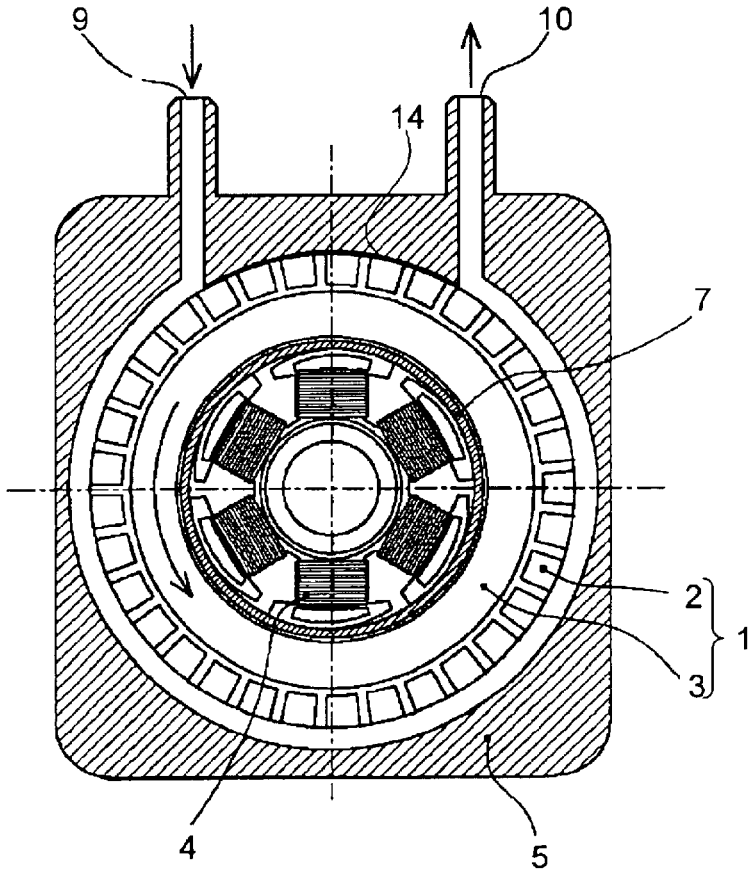
FIG. 2 is a sectional view of the ultra-thin pump seen from a direction of an axis of rotation in accordance with the first embodiment.

FIG. 1 is a sectional side elevation of an ultra-thin pump in accordance with the first exemplary embodiment of the present invention. FIG. 2 is a sectional view of the same pump seen from a direction of an axis of rotation in accordance with the first embodiment, and FIG. 3 is an exploded perspective view of the same pump in accordance with the first embodiment.

Figure 3:
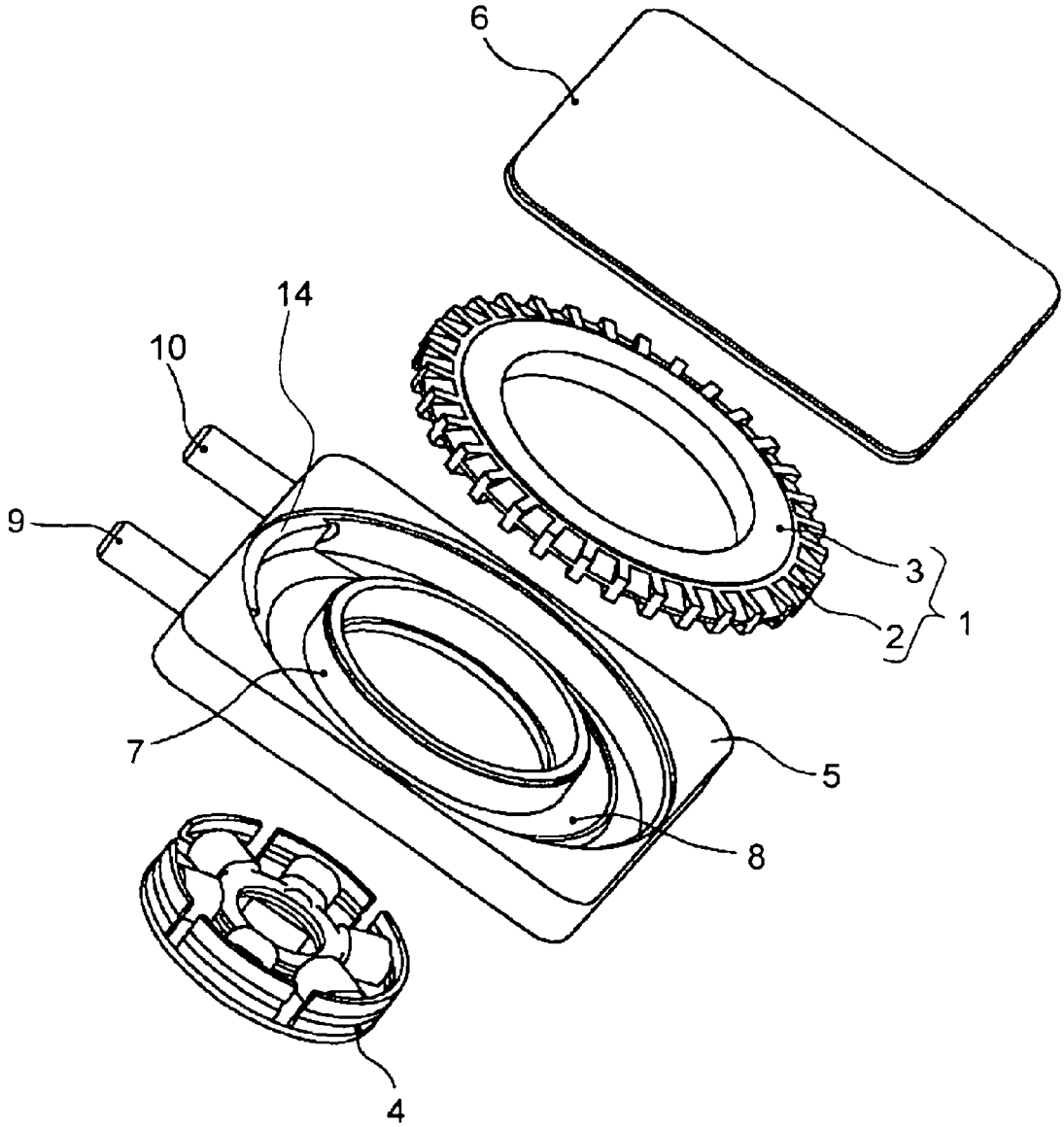
FIG. 3 is an exploded perspective view of the ultra-thin pump in accordance with the first embodiment.

As shown in FIGS. 1–3, ring-shaped impeller 1 includes many vanes 2 arranged along its outer region, and rotor magnet 3 at its inner region. Vanes 2 of the present embodiment are vanes for a regenerative pump. From this point of view, the pump of this embodiment can be basically referred to as an ultra-thin regenerative pump, but the present invention is not limited to the regenerative pump. The pump of the present invention is referred to as the ultra-thin pump in the sense that a new type of impeller is used to achieve this ultra-thin type. Vanes 2 and rotor magnet 3 are integrated into ring-shaped impeller 1 by fitting and may be made of different materials or the same material such as magnetic resin. Motor stator 4 is disposed in a space encircled by an inner peripheral surface of impeller 1. Pump casing 5 houses impeller 1 and defines a pump chamber for recovering pressure from kinetic energy imparted to fluid by impeller 1 and directing the fluid to discharge port 10. Casing cover 6 forms the pump integrally with pump casing 5 by sealing the pump chamber after impeller 1 is stored in pump casing 5. Pump casing 5 includes cylinder 7, disposed between motor stator 4 and rotor magnet 3, for rotatably supporting impeller 1, and thrust plate 8 for bearing a thrust load at a side of impeller 1. Casing cover 6 has another thrust plate 8. Suction port 9 and discharge port 10 are disposed on a sidewall of pump casing 5. In the present embodiment, these ports 9, 10 are provided on the same sidewall. Suction and discharge ports 9, 10 communicate with cylinder 7. A fluid passage is formed to surround impeller 1, and bulkhead 14 is provided between suction port 9 and discharge port 10 to block the passage of the fluid.

An operation of the ultra-thin pump of the first embodiment is described hereinafter. When electric power is supplied from an external power source, current controlled by an electric circuit (not shown) provided at the pump flows through coils of motor stator 4, which in turn generates a rotating magnetic field. This rotating magnetic field acts on rotor magnet 3 to impart physical force (rotational torque) to magnet 3. Since rotor magnet 3 is an integral part of ring-shaped impeller 1, which is rotatably supported by cylinder 7 of pump casing 5, the rotational torque acts on impeller 1, whereby impeller 1 starts to rotate. Vanes 2 arranged along the outer region of impeller 1 impart kinetic energy to the fluid flowing in from suction port 9 during the rotation of impeller 1. The kinetic energy imparted gradually increases pressure of the fluid within pump casing 5, and then the fluid is discharged from discharge port 10. Even when the thrust load changes due to a change of load on the pump or the installation condition of the pump, each thrust plate 8 bears the thrust load of impeller 1, thereby stabilizing the operation of the pump.

The present embodiment described above can minimize the pump's length along an axis of rotation, thereby making the pump ultra-thin because of the following structure. Vanes 2 and rotor magnet 3 are integrated into ring-shaped impeller 1 having the axis of rotation. Cylinder 7 rotatably supports impeller 1 and simultaneously acts as a separator, like the one used in a sealless pump. Impeller 1 is stored in pump casing 5, and motor stator 4 is inserted into a center part encircled by an inner wall of cylinder 7. The present embodiment can also simplify the structure of the pump and allows cost reduction because vanes 2, rotor magnet 3 and the axis of rotation are integrated.

Since each thrust plate 8 bears the thrust load, the pump can be operated stably even when the thrust load changes due to the change of load on the pump or the installation condition of the pump. The thrust load at each side of impeller 1 is also borne by a thrust magnetic bearing achieved by a magnetic interaction between rotor magnet 3 and motor stator 4, so that impeller 1 can be rotated with its sides out of contact with respective thrust plates 8 of pump casing 5. Accordingly, friction can be minimized. This allows the pump to have high efficiency and an extended life.

The integration of rotor magnet 3 and vanes 2 into ring-shaped impeller 1 made of the magnetic material realizes the simple structure and the cost reduction. The magnet can be made larger to improve motor performance or pump performance. If the pump is a high head regenerative pump having the enhanced ability to discharge bubbles, the pump can secure a required flow rate even in a circulatory system having a high resistance in a pipe line and can continuously discharge the bubbles flowing in without retaining the bubbles.

(Exemplary Embodiment 2)

An ultra-thin pump in accordance with the second exemplary embodiment of the present invention is described hereinafter with reference to FIG. 4, which is an exploded perspective view of the pump. It is to be noted that elements similar to those in the first embodiment have the same reference marks, and the detailed descriptions of those elements are omitted.

Figure 4:
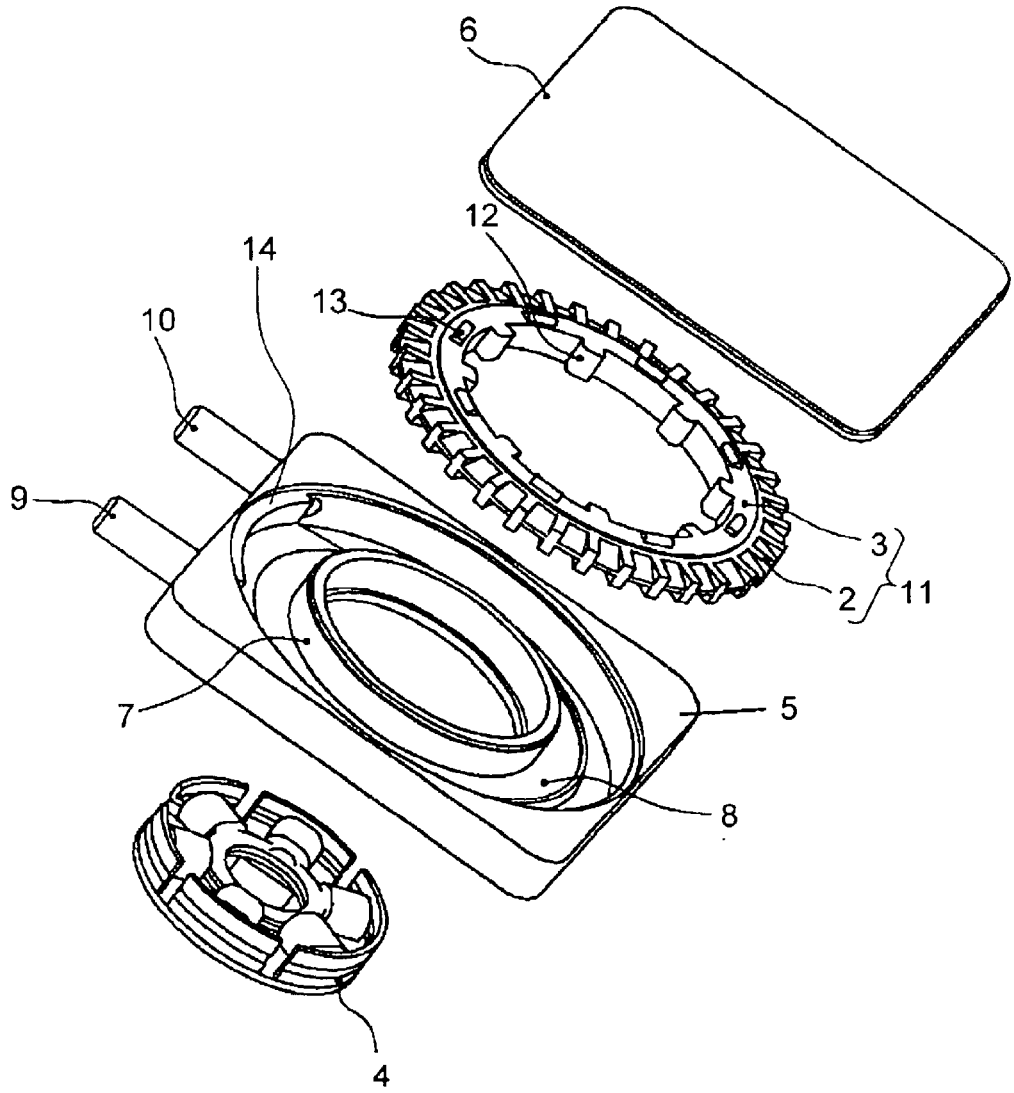
FIG. 4 is an exploded perspective view of an ultra-thin pump in accordance with a second exemplary embodiment of the present invention.

In FIG. 4, ring-shaped impeller 11 includes many vanes 2 arranged along its outer region, and rotor magnet 3 at its inner region, and is provided with a plurality of projections 12 on its inner peripheral surface and a plurality of projections 13 on its top and bottom surfaces. Rotor magnet 3, vanes 2, projections 12 and projections 13 are integrated into impeller 11 through fitting and may be made of different materials or the same material such as magnetic resin. It is preferable that projections 12, 13 are each made of material having a low coefficient of friction and good wear resistance. It is also preferable that projections 12, 13 each have the shape of a part of a sphere, a cylinder or the like that reduces friction. Pump casing 5 defines a pump chamber and includes cylinder 7, and thrust plate 8 for bearing a thrust load at a side of impeller 11. Motor stator 4 is provided in a space encircled by an inner wall of cylinder 7, and the pump chamber is sealed with casing cover 6. Casing cover 6 has another thrust plate 8. Pump casing 5 also includes suction port 9 and discharge port 10.

An operation of the ultra-thin pump of the second embodiment is described hereinafter. When electric power is supplied from an external power source, current controlled by an electric circuit provided at the pump flows through coils of motor stator 4, which in turn generates a rotating magnetic field. This rotating magnetic field acts on rotor magnet 3 to impart physical force (rotational torque) to magnet 3. Because rotor magnet 3 is an integral part of ring-shaped impeller 11, and impeller 11 is rotatably supported by cylinder 7 of pump casing 5, the rotational torque acts on impeller 11, whereby impeller 11 starts to rotate. Vanes 2 arranged along the outer region of impeller 11 impart kinetic energy to fluid flowing in from suction port 9 during the rotation of impeller 11. The kinetic energy imparted gradually increases pressure of the fluid within pump casing 5, and then the fluid is discharged from discharge port 10.

In the present embodiment, projections 12 bear sliding friction between the inner peripheral surface of impeller 11 and cylinder 7 of pump casing 5 during the rotation of impeller 11. This leads to reduced sliding area and reduced friction loss. Since each thrust plate 8 bears the thrust load of impeller 11, the pump is operated stably even when the thrust load changes due to a change of load on the pump or the installation condition of the pump. During the rotation of impeller 11, projections 13 bear sliding friction between the flat surface of impeller 11 and thrust plate 8 of pump casing 5, so that sliding area and friction loss are reduced.

As described above, the second embodiment can reduce the sliding area and minimize the friction by the use of projections 12, which bear the sliding friction between the inner peripheral surface of impeller 11 and cylinder 7 of pump casing 5 during the rotation of impeller 11. Thus, this embodiment allows the pump to have high efficiency and an extended life.

The second embodiment can enhance the efficiency of the pump further and extends the life of the pump further by reducing the sliding area and minimizing the friction through the use of projections 13, which bear the sliding friction between the flat surface of impeller 11 and thrust plate 8 of pump casing 5 during the rotation of impeller 11.

Figure 4A:
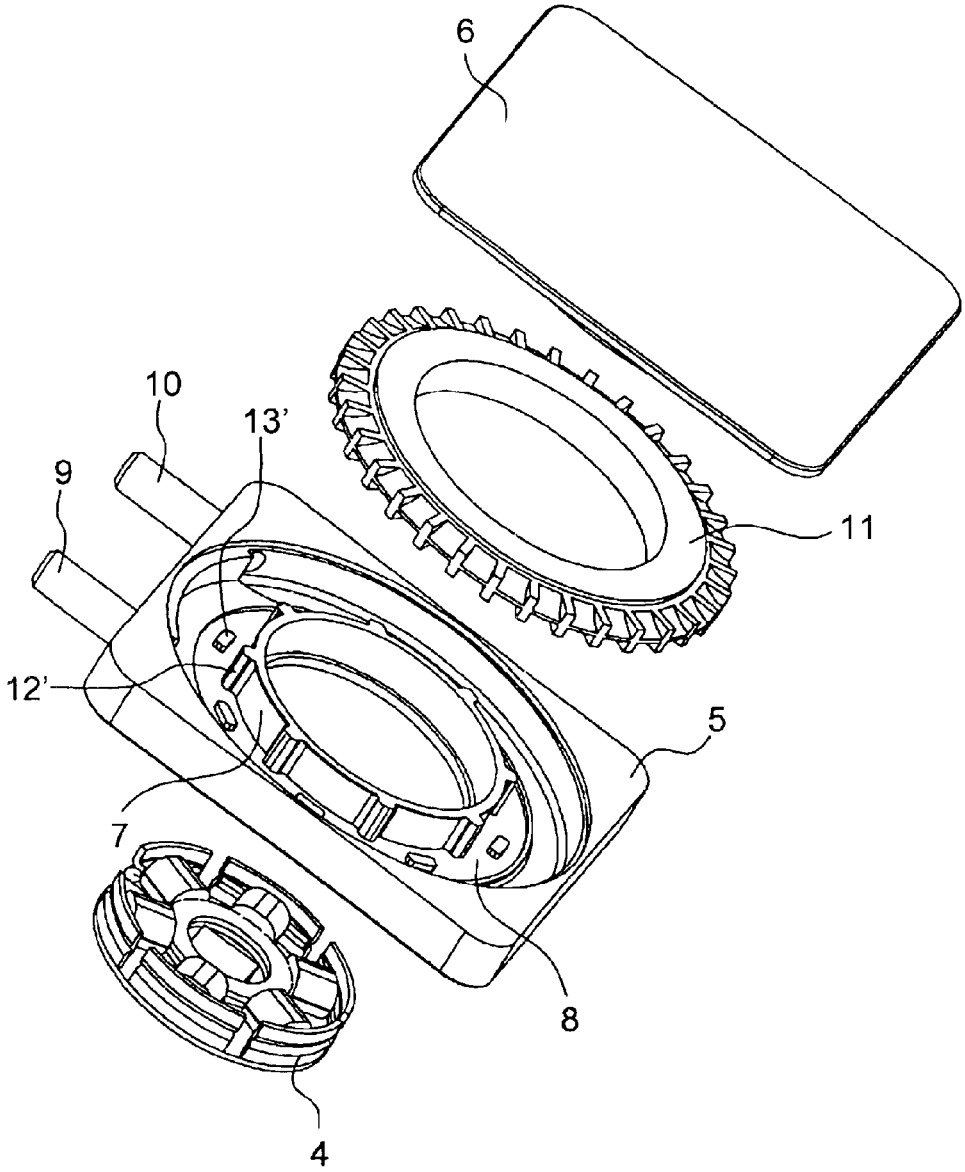
FIG. 4A is a view similar to FIG. 4 but showing a modification of the ultra-thin pump illustrated therein.

Instead of the inner peripheral surface of impeller 11 having projections 12 as in FIG. 4, cylinder 7 of pump casing 5 may have projections 12' as in FIG. 4A. Likewise, instead of the flat surfaces of impeller 11 having the projections 13 as in FIG. 4, thrust plate 8 of pump casing 5 may have projections 13' as in FIG. 4A.

(Exemplary Embodiment 3)

A cooling system, which includes an ultra-thin pump, in accordance with the third exemplary embodiment is described hereinafter with reference to FIG. 5, which is a diagram of the cooling system.

Figure 5:
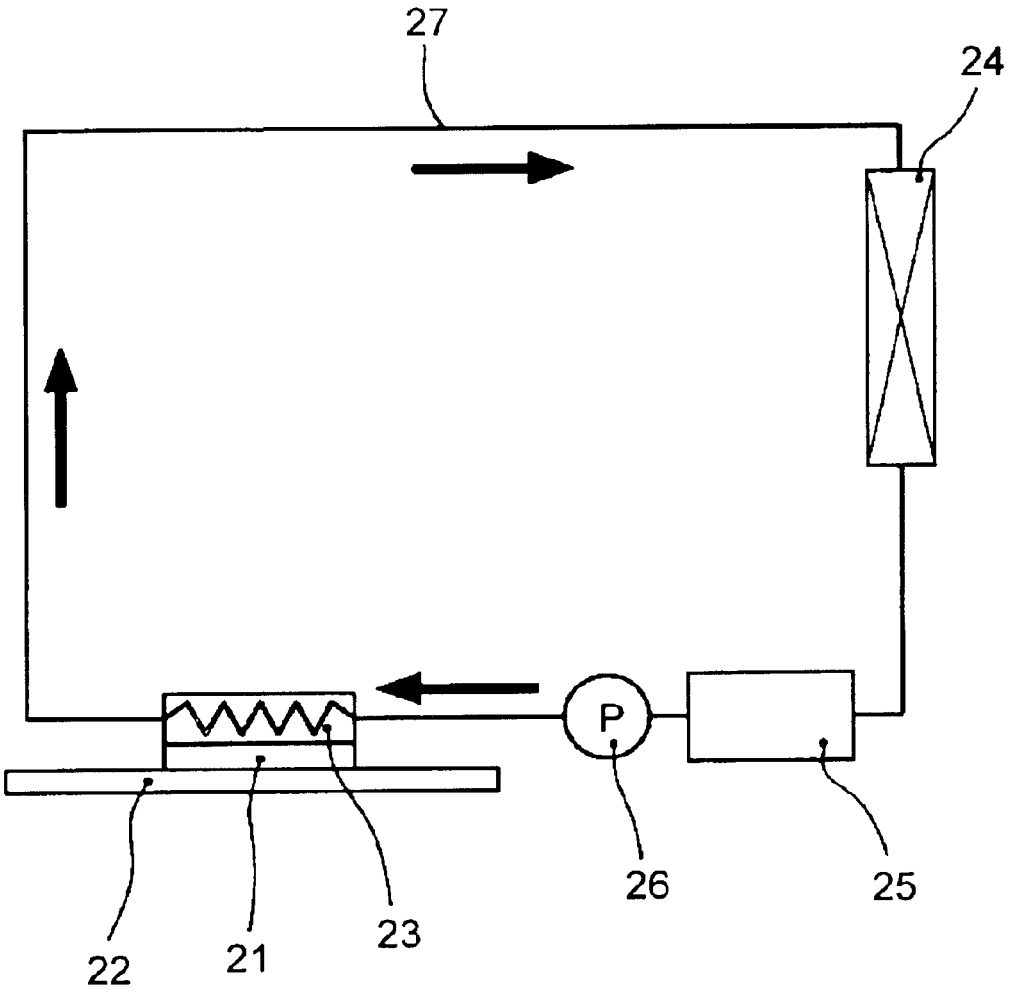
FIG. 5 is a diagram of a cooling system, which includes an ultra-thin pump, in accordance with a third exemplary embodiment of the present invention.

As shown in FIG. 5, the cooling system includes:

(1) cooling device 23 for cooling heat-producing device 21 by exchanging heat between heat-producing device 21 mounted on substrate 22 and coolant;

(2) radiator 24 for removing the heat from the coolant carrying the heat obtained at cooling device 23;

(3) reservoir 25 for storing the coolant;

(4) ultra-thin pump 26 for circulating the coolant; and (5) pipe line 27 for connecting these elements.

The cooling system of the present embodiment is used for cooling heat-producing device 21 such as an electronic device used in a small-size personal computer. The ultra-thin pump of the first or second embodiment is used as ultra-thin pump 26 of this embodiment. However, pump 26 may be a pump of any one of the other embodiments (described later) of the present invention.

An operation of the cooling system of the third embodiment is described hereinafter. The coolant is discharged from within reservoir 25 through pump 26 and is directed through pipe line 27 to cooling device 23 at which the coolant heats up to a high temperature by removing the heat from heat-producing device 21. The coolant is then directed to radiator 24 to be cooled to a low temperature by radiator 24 and returns to reservoir 25. By being circulated by pump 26, the coolant cools heat-producing device 21 such as the electronic device of the small-size personal computer or the like, thereby allowing device 21 to be used stably.

As described above, the third embodiment can make the entire system low-profile by using ultra-thin pump 26 for the circulation of the coolant. In this cooling system for cooling the electronic device of the small-size personal computer or the like, reservoir 25, ultra-thin pump 26, cooling device 23 and radiator 24 are connected by pipeline 27. With this structure, each element can be disposed optimally, and efficient cooling can be achieved with the electronic apparatus such as the small-size personal computer reduced in thickness. If the coolant is an antifreezing fluid, the cooling system can be prevented, even in a cold place, from suffering a breakdown, which occurs when the coolant freezes. If the antifreezing fluid is a fluorine-based inert liquid, a breakdown of the electronic device can be prevented even in case of leakage of the coolant.

If the pump is a high head regenerative pump having the enhanced ability to discharge bubbles, the pump can secure a required flow rate even in a circulatory system having a high resistance in pipe line 27. Accordingly, cooling device 23 and radiator 24 can be made low-profile, and pipe line 27 can have a small diameter. Consequently, the cooling system can be made smaller and thinner. Even when air enters pipe line 27, pump performance or cooling performance is not impaired because the pump can continuously discharge the bubbles flowing into the pump toward reservoir 25 without retaining the bubbles.

(Exemplary Embodiment 4)

Figure 6:
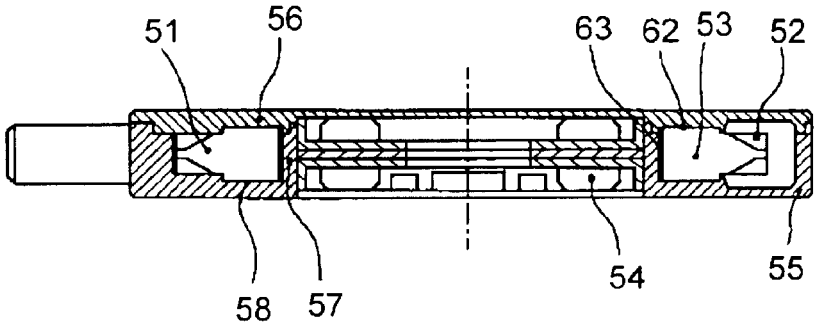
FIG. 6 is a sectional side elevation of an ultra-thin pump in accordance with a fourth exemplary embodiment of the present invention.
Figure 7:
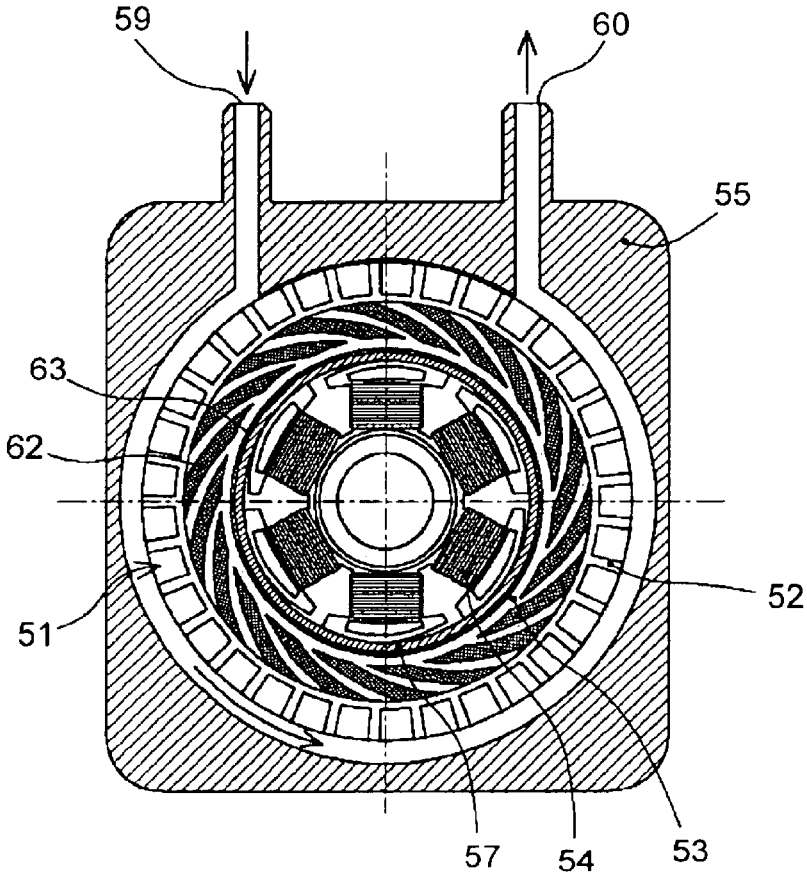
FIG. 7 is a sectional view of the ultra-thin pump seen from a direction of an axis of rotation in accordance with the fourth embodiment.
Figure 8:
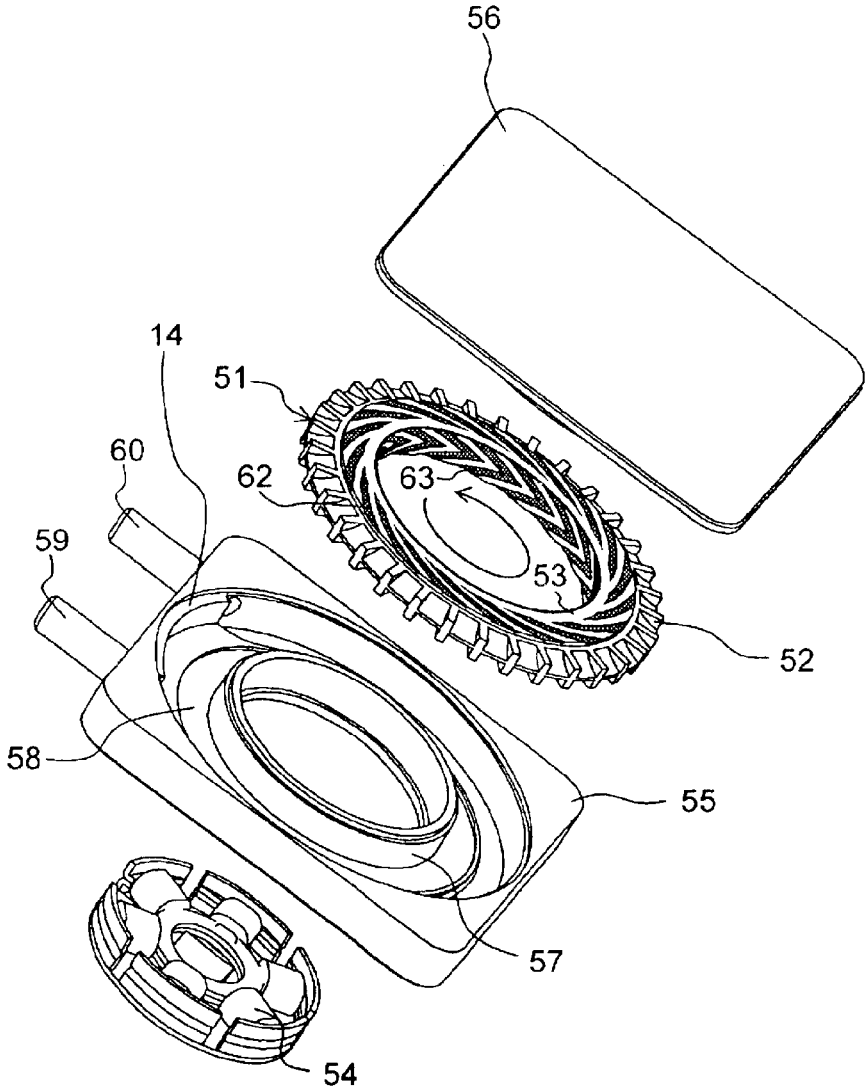
FIG. 8 is an exploded perspective view of the ultra-thin pump in accordance with the fourth embodiment.
Figure 9:
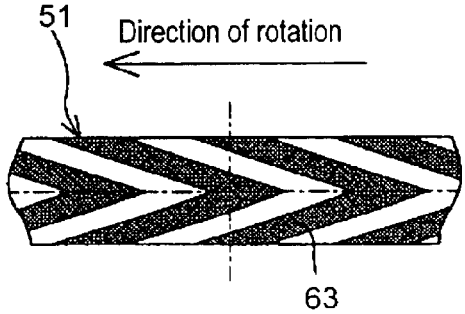
FIG. 9 is a view of an inner peripheral surface of a ring-shaped impeller of the ultra-thin pump in accordance with the fourth embodiment.
Figure 10:
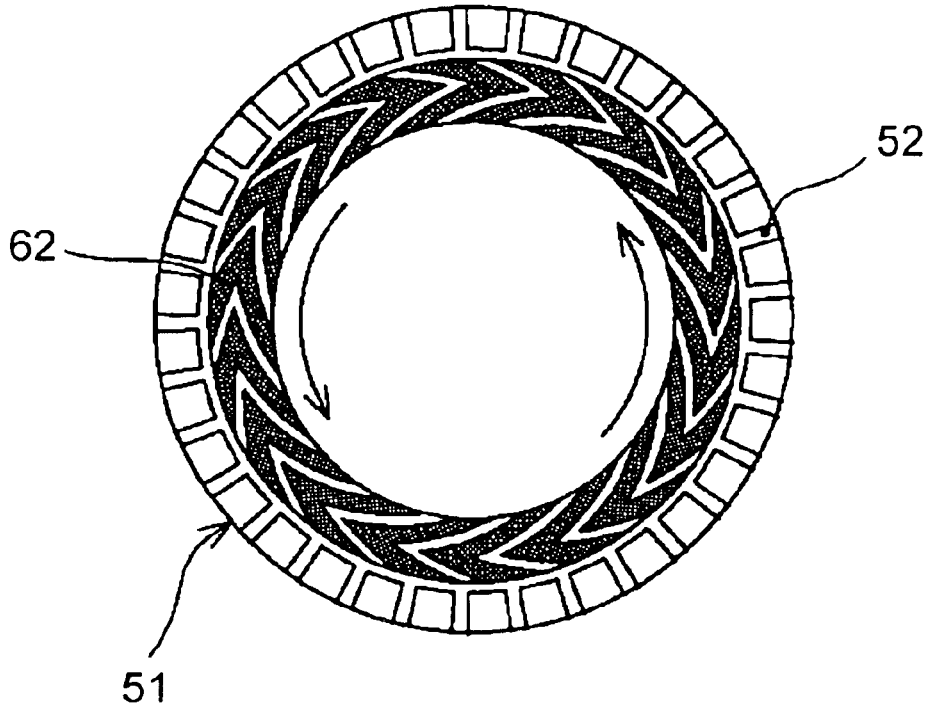
FIG. 10 is a plan view of a ring-shaped impeller having a herringbone pattern of thrust-dynamic-pressure-generating grooves for an ultra-thin pump in accordance with the fourth embodiment.

FIG. 6 is a sectional side elevation of an ultra-thin pump in accordance with the fourth exemplary embodiment, FIG. 7 is a sectional view of the same pump seen from a direction of an axis of rotation, and FIG. 8 is an exploded perspective view of the same pump. FIG. 9 is a view of an inner peripheral surface of a ring-shaped impeller of the same pump, and FIG. 10 is a plan view of a ring-shaped impeller having a herringbone pattern of thrust-dynamic-pressure-generating grooves for an ultra-thin pump.

As shown in FIGS. 6–10, ringshaped impeller 51 includes many vanes 52 arranged along its outer region, and rotor magnet 53 at its inner region. Top and bottom flat surfaces of this impeller 51 each include thrust-dynamic-pressure-generating grooves 62 arranged in a spiral pattern, while the inner peripheral surface of impeller 51 includes radial-dynamic-pressure-generating grooves 63 arranged in a herringbone pattern (see FIGS. 8 and 9). Vanes 52 of the present embodiment are vanes for a regenerative pump. However, it is to be noted that the ultra-thin pump of this embodiment is not limited to the regenerative pump.

The spiral pattern of thrust-dynamic-pressure-generating grooves 62 (hereinafter referred to as "grooves 62") causes such pumping action as to draw fluid toward an inner periphery of grooves 62 when impeller 51 is rotated, thereby forming a circulating flow at the flat surface of impeller 51 to support impeller 51 in a thrust direction. The herringbone pattern of radial-dynamic-pressure-generating grooves 63 (hereinafter referred to as "grooves 63") causes such pumping action as to draw the fluid contacting the inner peripheral surface of impeller 51 from both sides of the inner peripheral surface toward a middle line between these sides during the rotation of impeller 51, thereby supporting impeller 51 radially.

Motor stator 54 is provided in a space encircled by the inner peripheral surface of rotor magnet 53. Pump casing 55 houses ring-shaped impeller 51 and defines a pump chamber for recovering pressure from kinetic energy imparted to the fluid by impeller 51 and directing the fluid to discharge port 60. Casing cover 56 becomes a part of pump casing 55 by sealing the pump chamber after the storage of impeller 51. Pump casing 55 includes cylinder 57, disposed between motor stator 54 and rotor magnet 53, for rotatably supporting impeller 51, and thrust plate 58 for bearing a thrust load at the side of impeller 51. Casing cover 56 has another thrust plate 58. Pump casing also includes suction port 59, discharge port 60 and bulkhead 14.

An operation of the ultra-thin pump of the fourth embodiment is described hereinafter. When electric power is supplied from an external power source, current controlled by an electric circuit provided at the pump flows through coils of motor stator 54, which in turn generates a rotating magnetic field. This rotating magnetic field acts on rotor magnet 53 to impart physical force (rotational torque) to magnet 53. Since rotor magnet 53 is an integral part of ring-shaped impeller 51, which is rotatably supported by cylinder 57 of pump casing 55, the rotational torque acts on impeller 51, whereby impeller 51 starts to rotate. Vanes 52 arranged along the outer region of impeller 51 impart the kinetic energy to the fluid flowing in from suction port 59 during the rotation of impeller 51. The kinetic energy imparted gradually increases pressure of the fluid within pump casing 55, and then the fluid is discharged from discharge port 60.

When impeller 51 rotates, grooves 62 cause the pumping action, and the fluid is drawn toward the inner periphery of grooves 62 accordingly. Consequently, thrust dynamic pressure is generated between each of the sides of impeller 51 and corresponding thrust plate 58 of pump casing 55, causing impeller 51 not to contact thrust plates 58 during the rotation. Grooves 63 also cause the pumping action when impeller 51 rotates, and the fluid contacting the inner peripheral surface of impeller 51 is drawn from both the sides of the inner peripheral surface toward the middle line between these sides accordingly. Consequently, radial dynamic pressure is generated between the inner peripheral surface of impeller 51 and cylinder 57 of pump casing 55, causing impeller 51 not to contact cylinder 57 during the rotation. As a result of these pumping actions, impeller 51 levitates and rotates entirely out of contact with pump casing 55.

Figure 8A:
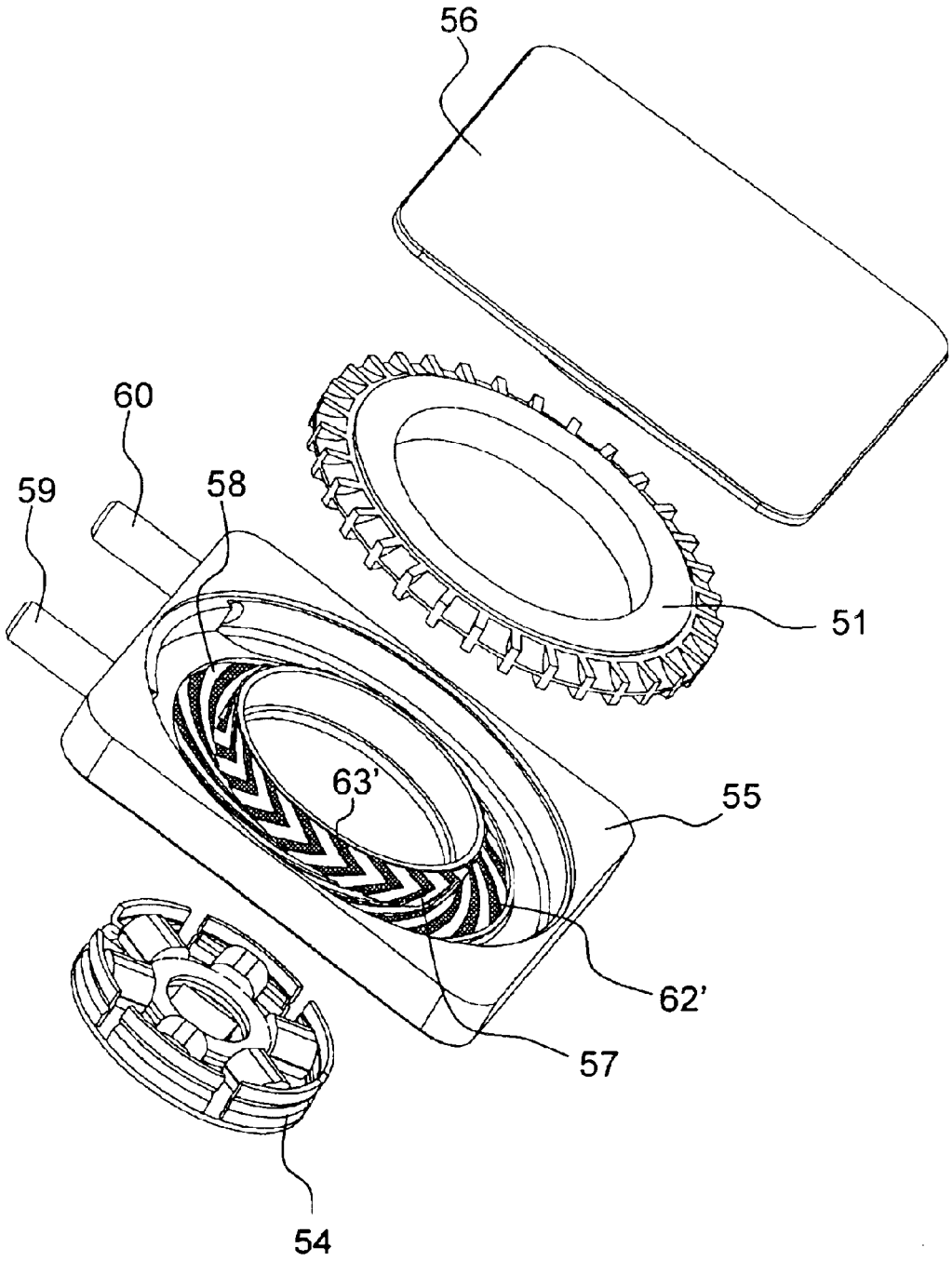
FIG. 8A is a view similar to FIG. 8 but showing a modification of the ultra-thin pump illustrated therein.

In the present embodiment, grooves 62 have been arranged in a spiral pattern. However, grooves 62 may be arranged in a herringbone pattern, as shown in FIG. 10, to draw the fluid contacting the flat surface of impeller 51 from an inner periphery and an outer periphery of impeller 51 toward a middle line between these peripheries for the generation of the thrust dynamic pressure. Instead of ring-shaped impeller 51, thrust plates 58 (i.e., surfaces facing the respective top and bottom flat surfaces of impeller 51) of pump casing 55 may have grooves 62', and cylinder 57 of pump casing 55 may have grooves 63', as shown in FIG. 8A.

As described above, the fourth embodiment allows ring-shaped impeller 51 to rotate out of contact with thrust plates 58 by providing grooves 62 at the top and bottom flat surfaces of impeller 51 for the generation of the dynamic pressure between the top flat surface of impeller 51 and thrust plate 58 of pump casing 55 as well as between the bottom flat surface of impeller 51 and another thrust plate 58 of pump casing 55. Thus, the ultra-thin pump can have high performance, an extended life and less noise.

A pump of this embodiment is 5 to 10 mm thick in the direction of the axis of rotation and 40 to 50 mm wide typically in the radial direction. The rotation rate is up to 1200 r.p.m. The flow rate is 0.08 to 0.12 $dm^3$ per minute. The head is 0.35 to 0.45 m. So a pump according to this invention has such dimensions and performances including the pump of embodiment 1 as below:

1) The thickness in the direction of axis of rotation is 3 to 15 mm.
2) The width typically in the radial direction is 10 to 70 mm.
3) The flow rate is 0.01 to 0.5 $dm^3$ per minute.
4) The head is 0.1 to 2 m.

This pump is completely different from conventional ones at the point of dimensions, of which specific speed is 24 to 28 (calculated using m, $m^3$ per minute, r.p.m. as the unit systems).

This embodiment can enhance the performance of the pump further, extends the life of the pump further and reduce the noise of the pump further by the use of grooves 63 provided at the inner peripheral surface of impeller 51. These grooves 63 cause the dynamic pressure between the inner peripheral surface of impeller 51 and cylinder 57 of pump casing 55. Consequently, impeller 51 rotates out of contact with cylinder 57. In other words, impeller 51 can levitate and rotate entirely out of contact with pump casing 55.

(Exemplary Embodiment 5)

Figure 11:
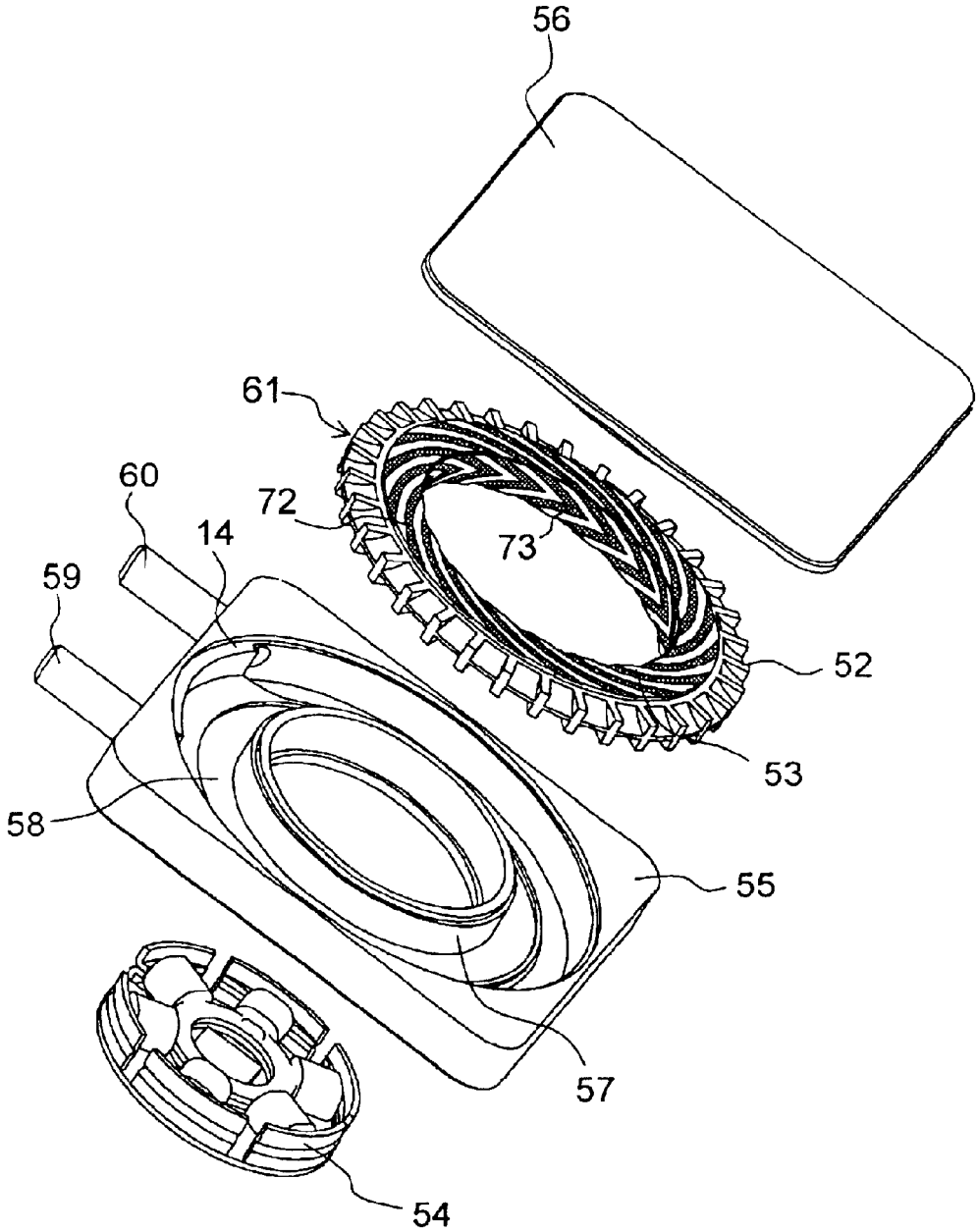
FIG. 11 is an exploded perspective view of an ultra-thin pump in accordance with a fifth exemplary embodiment of the present invention.

FIG. 11 is an exploded perspective view of an ultra-thin pump in accordance with the fifth exemplary embodiment.

As shown in FIG. 11, ring-shaped impeller 61 includes many vanes 52 arranged along its outer region, and rotor magnet 53 at its inner region. Top and bottom flat surfaces of this impeller 61 each include thrust-dynamic-pressure-generating grooves 72 (hereinafter referred to as "grooves 72") arranged in a spiral pattern, while an inner peripheral surface of impeller 61 includes radial-dynamic-pressure-generating grooves 73 (hereinafter referred to as "grooves 73") arranged in a herringbone pattern. An end of each groove 72 connects with an end of corresponding groove 73. As in the fourth embodiment, the spiral pattern of grooves 72 causes such pumping action as to draw fluid toward an inner periphery of grooves 72 when impeller 61 is rotated, while the herringbone pattern of grooves 73 causes such pumping action as to draw the fluid contacting the inner peripheral surface of impeller 61 from both sides of the inner peripheral surface toward a middle line between these sides during the rotation of impeller 61.

Motor stator 54 is provided in a space encircled by the inner peripheral surface of rotor magnet 53. Pump casing 55 houses ring-shaped impeller 61 and defines a pump chamber for recovering pressure from kinetic energy imparted to the fluid by impeller 61 and directing the fluid to discharge port 60. Casing cover 56 becomes a part of pump casing 55 by sealing the pump chamber after the storage of impeller 61. Pump casing 55 includes cylinder 57, disposed between motor stator 54 and rotor magnet 53, for rotatably supporting impeller 61, and thrust plate 58 for bearing a thrust load at the side of impeller 61. Casing cover 56 has another thrust plate 58. Pump casing 55 also includes suction port 59, discharge port 60 and bulkhead 14.

When impeller 61 rotates, grooves 72 cause the pumping action, and the fluid is drawn toward the inner periphery of grooves 72 accordingly. Consequently, thrust dynamic pressure is generated between each of the sides of impeller 61 and corresponding thrust plate 58 of pump casing 55, causing impeller 61 not to contact thrust plates 58 during the rotation. Grooves 73 also cause the pumping action when impeller 61 rotates, and the fluid is drawn from both the sides of the inner peripheral surface of impeller 61 toward the middle line between these sides accordingly. Consequently, radial dynamic pressure is generated between the inner peripheral surface of impeller 61 and cylinder 57 of pump casing 55.

In the ultra-thin pump of the fifth embodiment, since grooves 72 communicate with respective grooves 73, the fluid is drawn from grooves 72 toward grooves 73, and the resulting radial dynamic pressure becomes high. Thus, impeller 61 can levitate and rotate entirely out of contact with pump casing 55 even when a radial load changes due to a change of load on the pump or the like.

As described above, the present embodiment ensures the generation of the radial dynamic pressure by connecting grooves 72 with respective grooves 73 to draw the fluid from grooves 72 toward grooves 73 during the rotation of impeller 61. Consequently, impeller 61 can levitate and rotate entirely out of contact with pump casing 55 even when the radial load changes due to the change of load on the pump or the like. This allows the pump to operate stably.

(Exemplary Embodiment 6)

Figure 12:
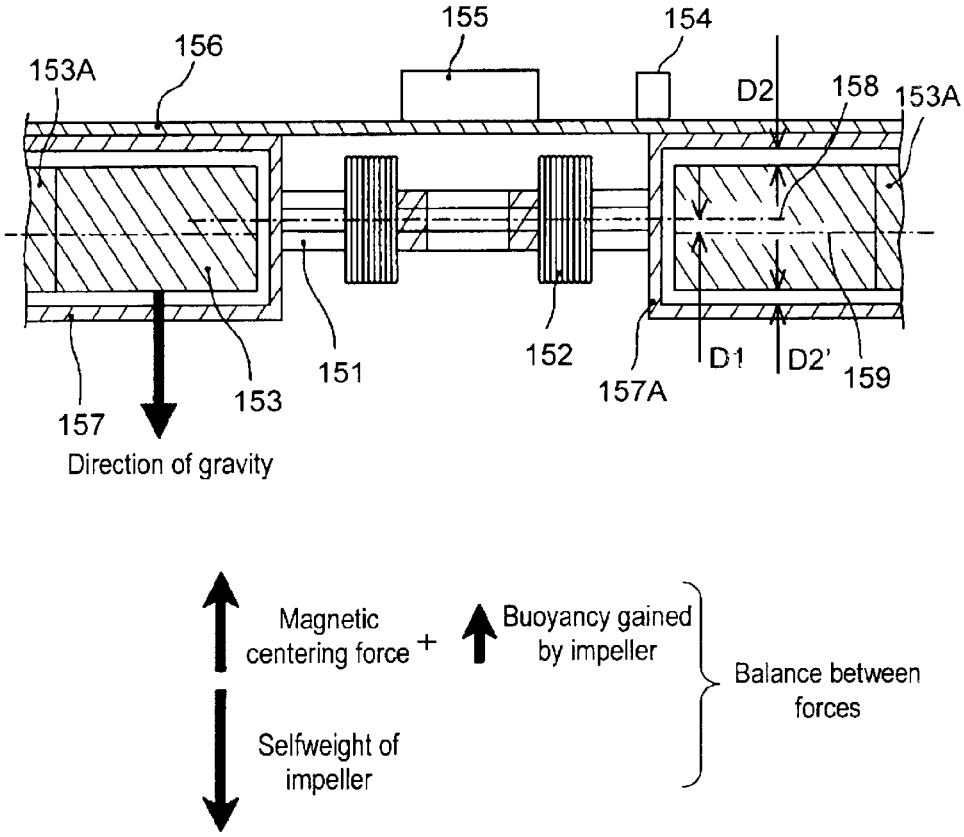
FIG. 12 is a sectional side elevation of an ultra-thin pump in accordance with a sixth exemplary embodiment of the present invention.
Figure 13:
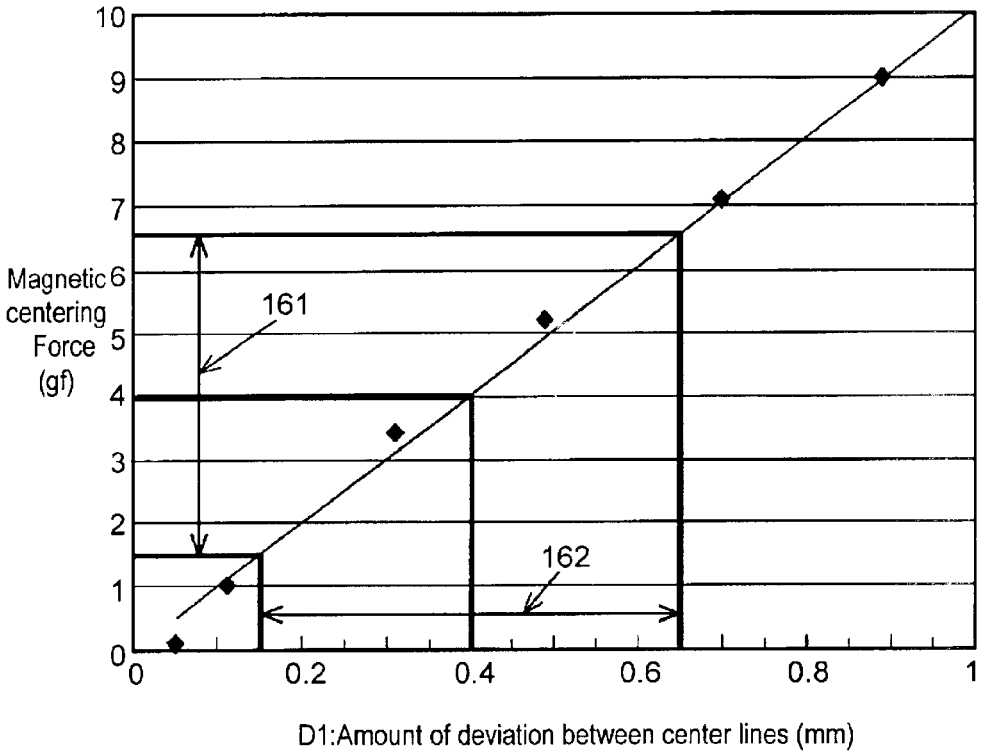
FIG. 13 is a graph showing a relationship between magnetic centering force and the amount of deviation between a center line of a stator core and a center line of a magnet rotor in accordance with the sixth embodiment.

FIG. 12 is a sectional side elevation of an ultra-thin pump in accordance with the sixth exemplary embodiment of the present invention, and FIG. 13 is a graph showing a relationship between magnetic centering force and the amount of deviation between a center line of a stator core and a center line of a magnet rotor.

Attraction and repulsion between an electromagnet, formed by passing current through stator windings 152 of stator core 151, and ring-shaped magnet rotor (which corresponds to the rotor magnet of the foregoing embodiments) 153 cause rotational torque in a specific direction. In a position where there is a balance between this rotational torque and load torque, magnet rotor 153 or impeller 153A including magnet rotor 153 as its integral part at its inner region rotates.

As shown in FIG. 12, the pump of the present embodiment is a regenerative pump, and impeller 153A includes a plurality of vanes arranged in a circle with a given pitch so that the adjacent vanes face each other across a recess. A motor used is an outer-rotor type brushless DC motor in which magnet rotor 153 rotates around stator core 151. It is to be noted that stator core 151 of the present embodiment corresponds to the motor stator of the foregoing embodiments. Magnetic-pole position sensor 154 determines a magnetic pole position of magnet rotor 153 to help control timing for the passage of current through stator windings 152, and direction of the passage of the current. Since sensor 154 detects a magnetic flux, which is a leakage flux of magnet rotor 153, it is desirable that sensor 154 be placed in a position to detect the greatest possible leakage flux. In this case, it is appropriate that sensor 154 be placed close to magnet rotor 153. Drive IC (also referred to as "a current controller" in the present invention) 155 controls the current to be passed through stator windings 152 upon receipt of an output signal from sensor 154 for more efficient generation of the rotational torque in the specific direction. Sensor 154 and drive IC 155 are electrically coupled to each other and mounted on substrate 156.

Pump casing 157 defines a pump chamber for housing impeller 153A, and includes cylinder 157A disposed between the pump chamber and stator core 151. Cylinder 157A supports magnet rotor 153 to allow rotor 153 to be rotatable within the pump chamber. Impeller 153A is submerged in liquid within pump casing 157, whereas stator core 151, stator windings 152, an electrical component on substrate 156, magnetic-pole position sensor 154 and drive IC 155 are all separated from the liquid by pump casing 157.

The pump illustrated by FIG. 12 is generally referred to as a sealless pump because this pump does not employ a shaft seal, and cylinder 157A of pump casing 157 serves as a partition between stator core 151 and others mentioned earlier and the pump chamber to separate the fluid from stator core 151 and others. Cylinder 157A and pump casing 157 are referred to as cans functioning as bulkheads, so that the pump is also referred to as a canned motor pump. The sealless pump has a long life because the pump uses no shaft seal for the motor and features sealing using cylinder 157A, as mentioned above. However, if this pump is placed sideways, as shown in FIG. 12, so that an axis of rotation is oriented vertically in the direction of gravity, a bottom surface (or a top surface if the pump is placed upside down) of impeller 153A mechanically contacts an inner surface of pump casing 157 during the rotation, thereby causing friction which reduces efficiency of the pump and shortens the life of the pump.

In the present invention, although the pump is placed sideways, as shown in FIG. 12, so that the axis of rotation is oriented vertically, center line 158 of stator core 151 is shifted against the direction of the gravity acting on magnet rotor 153 from center line 159 of magnet rotor 153. The amount of deviation thus obtained is denoted by reference mark D1, and a clearance between a top surface of magnet rotor 153 or impeller 153A and a top inner wall of casing 157, and a clearance between a bottom surface of rotor 153 or impeller 153A and a bottom inner wall of casing 157 are denoted by respective reference marks D2 and D2'. The shift causes the magnetic centering force (magnetic force, caused by the deviation, for aligning the two center lines), and a resultant force of this magnetic centering force and a buoyancy that magnet rotor 153 gains in the liquid acts on the selfweight of impeller 153A. The weight of impeller 153A and the resultant force are brought into balance so as to enable magnet rotor 153 to suspend in the liquid. Thus, magnet rotor 153 rotates mechanically out of contact with pump casing 157. This allows the sealless pump to maintain its long life and have reduced mechanical loss and high efficiency. Although center line 159 of magnet rotor 153 is a center line of impeller 153A in the strict sense, the above explanation uses the center line of impeller 153A as center line 159 of magnet rotor 153 because the magnetic force of rotor 153 is involved as the magnetic centering force.

FIG. 13 shows the measured relationship between the magnetic centering force and the amount of deviation D1 between center line 158 of stator core 151 and center line 159 of magnet rotor 153. When D1≦1 mm, a substantially linear series of relationships holds.

The measured selfweight and the measured volume of impeller 153A of the pump are 5 gf and 1 $cm^3$, respectively, and water is used as the fluid. In this case, the buoyancy acting on impeller 153A is 1 gf, so that a magnetic centering force of 4 gf is required to suspend impeller 153A. As shown in FIG. 13, the balance can be achieved when D1=0.4 mm. In rated operation of the pump, power consumption measures 1.4 W when D1=0 mm, whereas power consumption measures 1.0 W when D1=0.4 mm. This demonstrates that when D1=0.4 mm, a reduction of about 30% in power consumption can be achieved, and the pump can be operated at high efficiency.

FIG. 13 also shows range 161 of magnetic centering forces each converted from the amount of vibration applied to the pump, and amplitude 162 representing the maximum shake given by impeller 153A when the amount of vibration applied to the pump ranges between −0.5 G and +0.5 G with the viscosity of the fluid not taken into account. When no vibration is applied to the pump, the pump remains stationary with D1=0.4 mm. When the amount of vibration applied=+0.5 G, a new downward force of 0.25 gf acts on magnet rotor 153 to move rotor 153 downward (in the direction of the selfweight of impeller 153A). Consequently, the amount of deviation D1 increases 0.25 mm from 0.4 mm to achieve the balance, as shown in FIG. 13. Similarly, the amount of deviation D1 decreases 0.25 mm from 0.4 mm to achieve the balance when the amount of vibration applied=−0.5 G.

In other words, if each of the upper and lower clearances D2, D2' between magnet rotor 153 and pump casing 157 is equal to or greater than 0.25 mm, impeller 153A can rotate with its top and bottom surfaces mechanically out of contact with pump casing 157 even when a vertical vibration of +0.5 G is applied to the pump built into an electronic apparatus such as a personal computer.

In this embodiment, center line 159 of magnet rotor 153 is located under center line 158 of stator core 151. The adverse physical relationship of those center lines is possible. In this case, the amount of deviation of those center lines is also denoted by D1. And a clearance between a top surface of magnet rotor 153 or impeller 153A and a top inner wall of casing 157, and a clearance between a bottom surface of rotor 153 or impeller 153A and a bottom inner wall of casing 157, D2 and D2 respectively, are defined as magnetic centering force is found with D1 value using FIG. 13. In this case, the force faces in the direction of gravity.

(Exemplary Embodiment 7)

An ultra-thin pump in accordance with the seventh exemplary embodiment of the present invention is described hereinafter with reference to FIG. 14, which is a sectional side elevation of the pump. Elements similar to those in the sixth embodiment have the same reference marks, and the descriptions of those elements are omitted.

Figure 14:
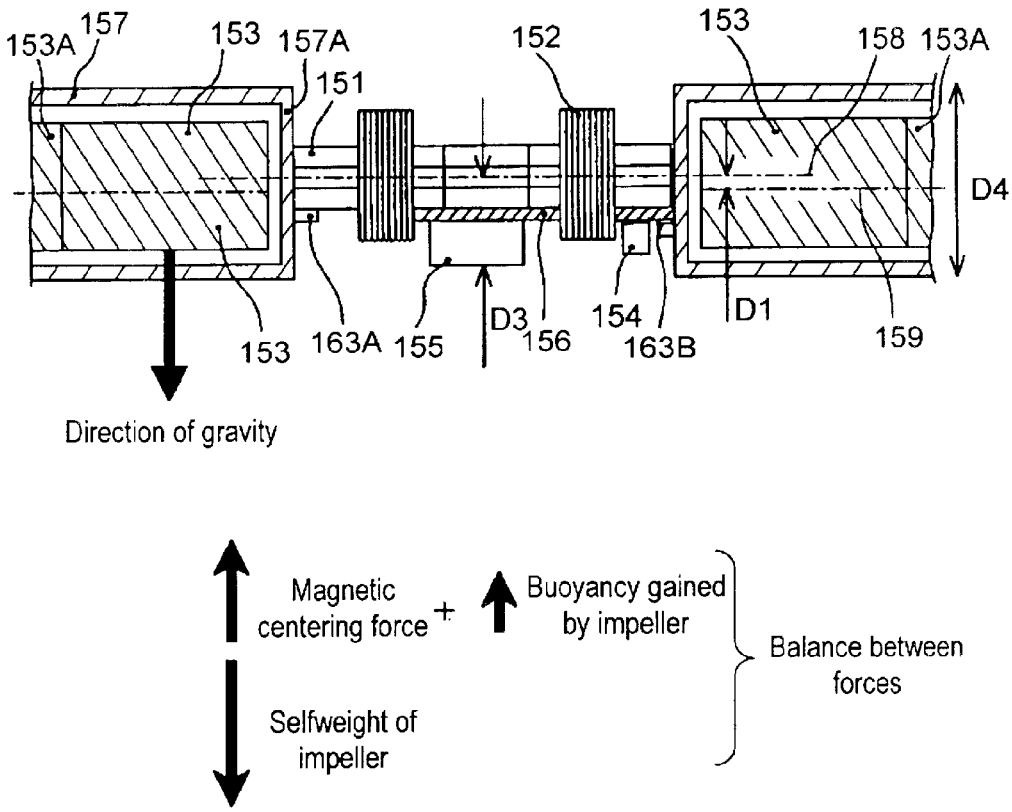
FIG. 14 is a sectional side elevation of an ultra-thin pump in accordance with a seventh exemplary embodiment of the present invention.
Figure 15:
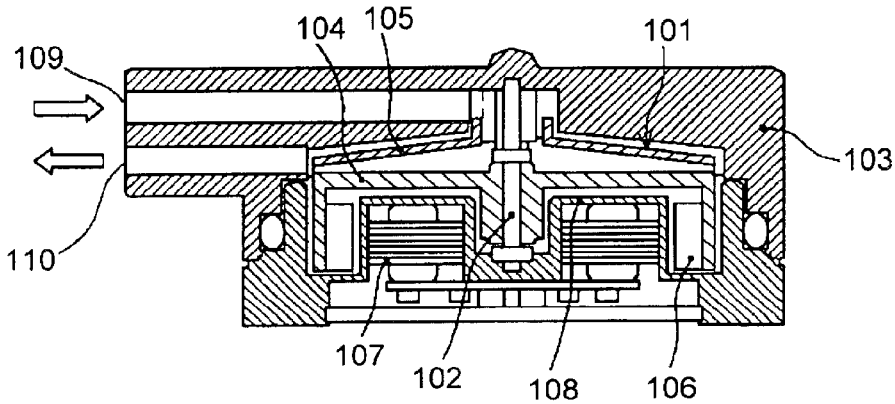
FIG. 15 PRIOR ART
FIG. 15 illustrates a conventional small-size centrifugal pump.

In FIG. 14, first projection 163A locks stator core 151 when core 151 is press-fitted to pump casing 157, thus securing the amount of deviation D1 between center line 158 of stator core 151 and center line 159 of magnet rotor 153. First projection 163A positions stator core 151 in place in the press fitting, so that the variation of the position of center line 158 does not occur.

Second projection 163B is provided at pump casing 157 and fixes substrate 156 by interposing substrate 156 between this projection 163B and stator core 151. A distance between first projection 163A and second projection 163B corresponds to the thickness of substrate 156 when measured along the direction of gravity. Because second projection 163B is provided in such a position, a motor can be reduced in thickness for the following reason.

As is clear from FIG. 14, it is necessary that a top surface of the tallest electrical component on substrate 156 mounted to stator core 151 should not project from a surface of pump casing 157 in order to reduce the thickness of the motor. It is to be noted here that the electric components such as magnetic-pole position sensor 154 and drive IC 155 are mounted on substrate 156. Moreover, the amount of deviation D1 between center line 158 of stator core 151 and center line 159 of magnet rotor 153 must be secured to provide magnetic centering force. This is necessary because impeller 153A must rotate out of contact with pump casing 157 to enable the ultra-thin pump to operate at high efficiency. Such being the case, a side of stator core 151 that is positioned on a downstream side of the direction of gravity is used to permit second projection 163B to fix substrate 156. Projection 163B positions and fixes substrate 156 in cooperation with stator core 151. When the thickness of the pump, and the sum of the thickness of substrate 156, the height of the tallest electric component and a half of the thickness of stator core 151 are denoted by D4 and D3, respectively, D4/2>D3−D1 holds easily as a result of the use of the side positioned on the downstream side of the direction of gravity for the placement of substrate 156. In other words, center line 159 of magnet rotor 153 is situated substantially in a center position of thickness D4 of the pump based on the balance between forces, and center line 158 of stator core 151 is situated in a position which is a distance D1 above center line 159, so that the sum of the height of substrate 156 and the height of the tallest electric component is partly accommodated by the amount of deviation D1. In this way, the top surface of the tallest electric component is prevented from projecting from the surface of pump casing 157.

In cases where substrate 156 mounted with the similar electric components is mounted to the other side of stator core 151, D4/2<D3+D1 may hold, and consequently, the thickness of the pump cannot be reduced by D1. For this reason, substrate 156 is mounted to the side of stator core 151 that is positioned on the downstream side of the direction of gravity, and is fixed by projection 163B. This can reduce the thickness of the pump, increase the efficiency of the pump and extend the life of the pump at the same time.

It is preferable that the ultra-thin pump of each one of the foregoing embodiments has a thickness of 3 mm to 15 mm. This range allows the pump to be used in an electronic apparatus, such as a notebook computer or a mobile apparatus, that is required to have reduced thickness. It is also preferable that the outside length and the outside width of the pump each range from 10 mm to 70 mm. This range allows the pump to be placed in a small space of a small size apparatus with densely mounted electronic devices, and also allows the pump to be overlaid or underlaid in the small-size apparatus. The inside diameter of each of the suction and discharge ports preferably ranges from 1 mm to 9 mm so that the pipe can be routed in a small space. With a thickness exceeding 15 mm, a conventional centrifugal pump miniaturized to this thickness can be utilized, but limits the miniaturization of the apparatus using the miniaturized centrifugal pump. With a thickness less than 3 mm, there are cases where the pump decreases in strength as well as in performance due to a small amount of suction of air or the like or the cooling system decreases in performance due to vaporization of the fluid through the pump casing so that the fluid decreases in quantity.

What is claimed is:

1. An ultra-thin pump comprising:

a ring-shaped impeller including a plurality of vanes at an outer region of said impeller, and a rotor magnet at an inner region of said impeller;

a motor stator provided in a space encircled by an inner peripheral surface of said impeller; and a pump casing for housing said impeller, said pump casing including a suction port, a discharge port and a cylinder disposed between said motor stator and said rotor magnet, wherein the dimension of said pump casing in a direction of a rotation axis of said impeller is at least 3 mm and at most 15 mm and the dimension of said pump casing in a radial direction of said impeller is at least 10 mm and at most 70 mm, and said impeller is rotatably supported by said cylinder.

2. The ultra-thin pump of claim 1, wherein one of said inner peripheral surface of said impeller, and an outer peripheral surface of said cylinder of said pump casing includes a plurality of projections.

3. The ultra-thin pump of claim 1, wherein said pump casing further includes a thrust plate for bearing a thrust load at a flat surface of said impeller.

4. The ultra-thin pump of claim 3, wherein one of said thrust plate of said pump casing, and said flat surface of said impeller includes a plurality of projections.

5. The ultra-thin pump of claim 3, wherein said thrust plate includes thrust-dynamic-pressure generating grooves.

6. The ultra-thin pump of claim 5, wherein said thrust-dynamic-pressure-generating grooves are arranged in a spiral pattern to draw fluid toward an inner periphery of said grooves during rotation of said impeller.

7. The ultra-thin pump of claim 5, wherein said thrust-dynamic-pressure-generating grooves are arranged in a herringbone pattern.

8. The ultra-thin pump of claim 1, wherein said rotor magnet and said motor stator magnetically interact with each other to bear a thrust load at a flat surface of said impeller.

9. The ultra-thin pump of claim 1, wherein at least one of said rotor magnet and said vanes of said impeller is made of a magnetic resin.

10. The ultra-thin pump of claim 1, wherein said impeller includes a flat surface including thrust-dynamic-pressure-generating grooves.

11. The ultra-thin pump of claim 10, wherein said thrust-dynamic-pressure-generating grooves are arranged in a spiral pattern to draw fluid toward an inner periphery of said grooves during rotation of said impeller.

12. The ultra-thin pump of claim 10, wherein said thrust-dynamic-pressure-generating grooves are arranged in a herringbone pattern.

13. The ultra-thin pump of claim 1, wherein one of said inner peripheral surface of said impeller, and an outer peripheral surface of said cylinder includes radial-dynamic-pressure-generating grooves.

14. The ultra-thin pump of claim 13, wherein said radial-dynamic-pressure-generating grooves are arranged in a herringbone pattern.

15. The ultra-thin pump of claim 1, wherein said impeller includes a flat surface including thrust-dynamic-pressure-generating grooves, and said inner peripheral surface of said impeller includes radial-dynamic-pressure-generating grooves in fluid communication with said thrust-dynamic-pressure-generating grooves, respectively.

16. The ultra-thin pump of claim 1, wherein said rotation axis of said impeller is oriented in a direction of gravity, and a center line dividing a thickness of said rotor magnet equally is shifted in said direction of gravity from a center line dividing the thickness of said motor stator equally.

17. The ultra-thin pump of claim 16, wherein said pump casing includes a first projection for locking said motor stator when said motor stator is press-fitted.

18. The ultra-thin pump of claim 1, further comprising:

a magnetic-pole position sensor for detecting a magnetic pole position of said rotor magnet;

a current controller for controlling a current to be passed through said motor stator based on an output signal from said magnetic-pole position sensor; and a substrate mounted with said magnetic-pole position sensor and said current controller, said substrate being mounted to a side of said motor stator, said side of said motor stator being positioned on a downstream side of a direction of gravity.

19. The ultra-thin pump of claim 18, wherein said pump casing includes a second projection for positioning said substrate when said substrate is mounted and holding said substrate in cooperation with said motor stator so that said substrate is interposed between said motor stator and said second projection.

20. A cooling system comprising:

a cooling device for cooling a heat-producing device by heat exchange using a coolant;

a radiator for removing heat from said coolant; and an ultra-thin pump for circulating said coolant, said pump comprising:

a ring-shaped impeller including a plurality of vanes at an outer region of said impeller, and a rotor magnet at an inner region of said impeller;

a motor stator provided in a space encircled by an inner peripheral surface of said impeller; and a pump casing for housing said impeller, said pump casing including a suction port, a discharge port and a cylinder disposed between said motor stator and said rotor magnet, wherein said impeller is rotatably supported by said cylinder.

21. The cooling system of claim 20, wherein said heat-producing device includes an electronic device for a computer.

22. The cooling system of claim 20, wherein said coolant includes an antifreezing fluid.

23. The ultra-thin pump of claim 5, wherein said thrust-dynamic-pressure-generating grooves are arranged in a herringbone pattern.

* * * * *